US005819677A

United States Patent [19]

Livingston

[11] Patent Number: 5,819,677

[45] Date of Patent: Oct. 13, 1998

[54] HULL WITH LAMINAR FLOW INTERRUPTERS

[76] Inventor: David T. Livingston, 4445 - 54th SW., Seattle, Wash. 98116

[21] Appl. No.: 682,119

[22] Filed: Jul. 17, 1996

[51] Int. Cl.[6] ..... B63B 1/00

[52] U.S. Cl. ..... 114/271; 114/291

[58] Field of Search ..... D12/310, 313, D12/314; 114/56, 271, 288–291, 67 A, 67 R

[56] References Cited

U.S. PATENT DOCUMENTS

| | | | |
|---|---|---|---|
| 1,933,598 | 11/1933 | Parker | 114/289 |
| 2,039,585 | 5/1936 | Eddy et al. | 114/291 |
| 2,162,705 | 6/1939 | Diehl | 114/291 |
| 2,969,760 | 1/1961 | Eddy | 114/291 |
| 3,051,115 | 8/1962 | Canazzi | 114/56 |
| 3,974,790 | 8/1976 | Oldenburg | 114/291 |
| 4,702,188 | 10/1987 | Harilainen | 114/291 |
| 5,588,388 | 12/1996 | Maruyama et al. | 114/271 |

*Primary Examiner*—Ed L. Swinehart
*Attorney, Agent, or Firm*—Christensen O'Connor Johnson Kindness PLLC

[57] ABSTRACT

A boat with a unique hull that stabilizes watercraft during turning conditions in water, thereby substantially reducing or eliminating the side-to-side oscillation that is typical of prior art craft undergoing this maneuver. To achieve this enhanced stability, the hull has a series of ridges or troughs, or both, to disrupt laminar flow along the hull, when the craft turns. This disruption of laminar flow stabilizes the hull and substantially eliminates side-to-side oscillation.

8 Claims, 3 Drawing Sheets

HULL WITH LAMINAR FLOW INTERRUPTERS

FIELD OF THE INVENTION

The invention relates to the field of watercraft hull design for improved operating conditions. More particularly, the invention relates to a hull that includes laminar flow interrupters that stabilize the watercraft when it turns under speed thereby allowing better control.

BACKGROUND OF THE INVENTION

It has long been observed that when watercraft, such as boats (single or multiple hulled), jet skis, seaplanes, and the like, change direction while traveling under reasonable speed, a downward force is exerted on a forward portion of the hull tending to cause greater submersion of the hull. As a result, the submerged surface area of the hull increases so that drag forces also increase. At the same time, the increase in the craft's velocity acts to lift the hull from the water. These opposing forces result in an observable oscillation of the craft from side to side during turning, leading the occupants of the craft to feel that it is unstable under these conditions. This tendency of a watercraft to oscillate when turning has presented a long-standing problem in the field of hull design. To date, there is not yet any satisfactory solution to the problem. Thus, there yet exists a need for a hull that operates efficiently, without increased drag of forces when the craft is traveling in a straight course, and that minimizes or eliminates the downward suction force exerted by water flowing over the bow of the hull when the craft turns, so that the oscillation experienced in prior art watercraft is reduced or eliminated.

SUMMARY OF THE INVENTION

The invention provides a unique hull design that substantially eliminates the tendency of a watercraft to oscillate when it turns in water. As a result of the hull design of the invention, laminar flow of water across the bow section of the hull of a watercraft is disrupted when the craft turns, thereby substantially reducing or eliminating the suction that pulls the hull into the water. As a result, a balance is achieved between the lift on the hull caused by an increase in velocity during turning, and the opposing suction pressure on the hull, so that any oscillation from side-to-side is significantly reduced or eliminated, as compared to prior art watercraft.

The invention provides a watercraft that has a hull that includes laminar flow interrupters in a bow portion of the hull. These interrupters disrupt laminar flow of water over the bow portion when the watercraft turns. Moreover, the interrupters extend above the waterline of the hull when the watercraft cruises in a substantially straight path, at normal speeds.

In one embodiment, the laminar flow interrupters are in the form of outward-extending ridges, or wedges, on the hull of the watercraft. Preferably, these are longitudinal, relatively narrow ridges that are oriented with one end directed to the keel, and the other end to the chine. Moreover, while these ridges as a group may extend from keel to chine, they are preferably each shorter, so that each extends only a portion of the distance from keel to chine. Thus, a series of ridges are arranged so that the leading one is nearest the stem is also nearest the keel and each successive ridge is spaced so that it is further from both stem and keel. When the watercraft commences to turn, the leading laminar flow interrupter is the first to come into contact with the water and disrupt laminar flow over this portion of the hull.

In accordance with the invention, interruption of laminar flow may also be achieved by the use of other structures that are adapted to disrupt laminar flow of water over the hull to reduce or eliminate the suction force, as explained above. Thus, laminar flow interrupters in the form of troughs in the hull, in place of the wedged ridges described above, may also be used. Moreover, a combination of a leading ridge followed by a trailing trough is also useful. In addition, a combination of ridges and troughs may be used to produce the desired disruption of laminar flow. Indeed, a variety of patterns are possible, and aesthetically pleasing and useful variations are preferred. Alternating ridges and troughs are also useful.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, not to scale, wherein.

DETAILED DESCRIPTION OF THE PREFERRED EMBODIMENT

The invention provides a watercraft with a unique hull that substantially reduces or eliminates the side-to-side oscillation that is typically encountered when prior art watercraft turn in the water. The invention utilizes the principle of disrupting laminar flow of water across bow portions of the hull to substantially reduce or eliminate suction forces on the hull. As a result, a balance is achieved between lift forces, caused by increased relative velocity of the craft during turning, and suction forces on the hull so that the craft turns smoothly.

Figure 1:
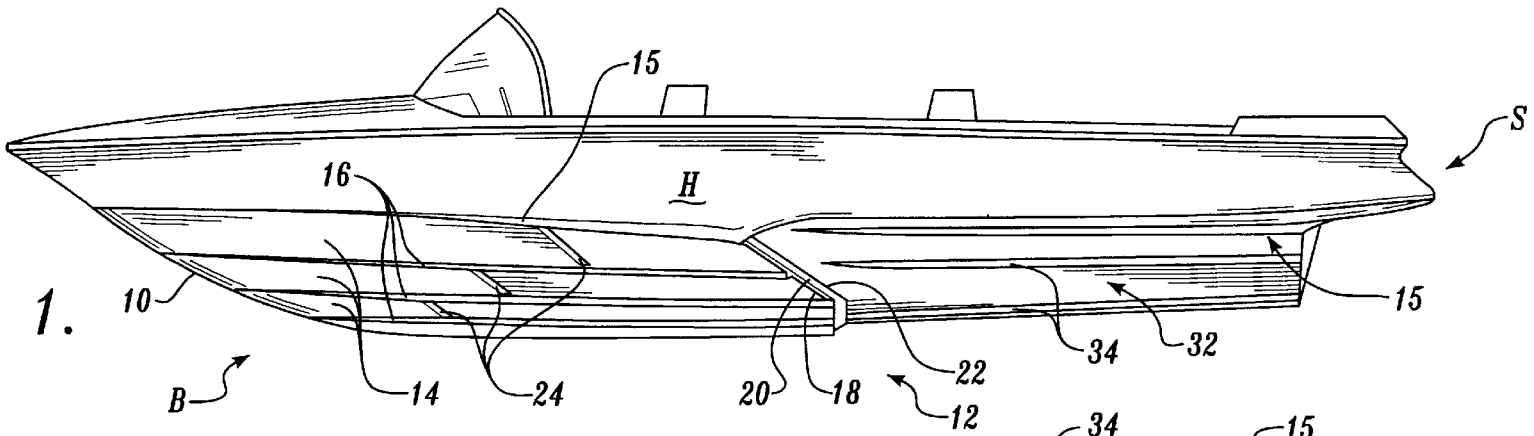
FIG. 1 is a schematic side view of an embodiment of a boat with a hull in accordance with the invention.

The invention is better understood with reference to the accompanying drawings that illustrate a preferred embodiment of the boat hull of the invention. Clearly, other embodiments of watercraft hulls utilizing the principles of the invention, as explained above, are also within the contemplation of the invention, which is not limited to the illustrated preferred embodiments. FIG. 1 shows a side view of a boat with a stepped hull H having a bow section B and a stern section S. Clearly, the invention also applies to other hull designs and other watercraft, as will be readily apparent from the principles of the invention explained herein. In FIG. 1, a stem 10 of the boat hull curves downward from a forward tip of the boat hull to flow smoothly into the keel 12 that extends substantially horizontally along the bottom edge of the hull. The stem and keel form a line of symmetry C of the hull (see FIG. 2). In this instance, though not of importance to the invention, the bow portion B of the stepped hull is separated from the stern portion 32 of the hull by a lateral dividing step 20, as will be explained below.

Figure 5:
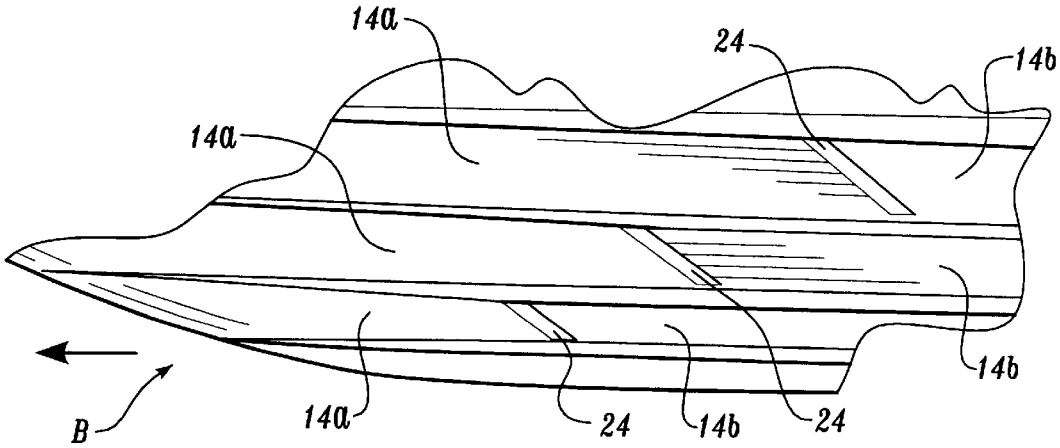
FIG. 5 is a more detailed partial side view of a bow portion of the hull of FIG. 1 schematically illustrating laminar flow interrupters on the hull.

A series of parallel horizontal longitudinal panels 14 extend from the bow 10 aft to a leading edge 18 of the lateral dividing step 20, that is about midway between the stem and the stem. Each of the panels has at least one laminar flow interrupter 24 in the form of a ridge, trough, or trough-and-ridge combination. The interrupter is oriented with one end directed toward the chine and the opposite end toward the keel, dividing the panel into a forward portion 14*a* and an aft portion 14*b*, as shown in FIGS. 5 and 6.

Figure 2:
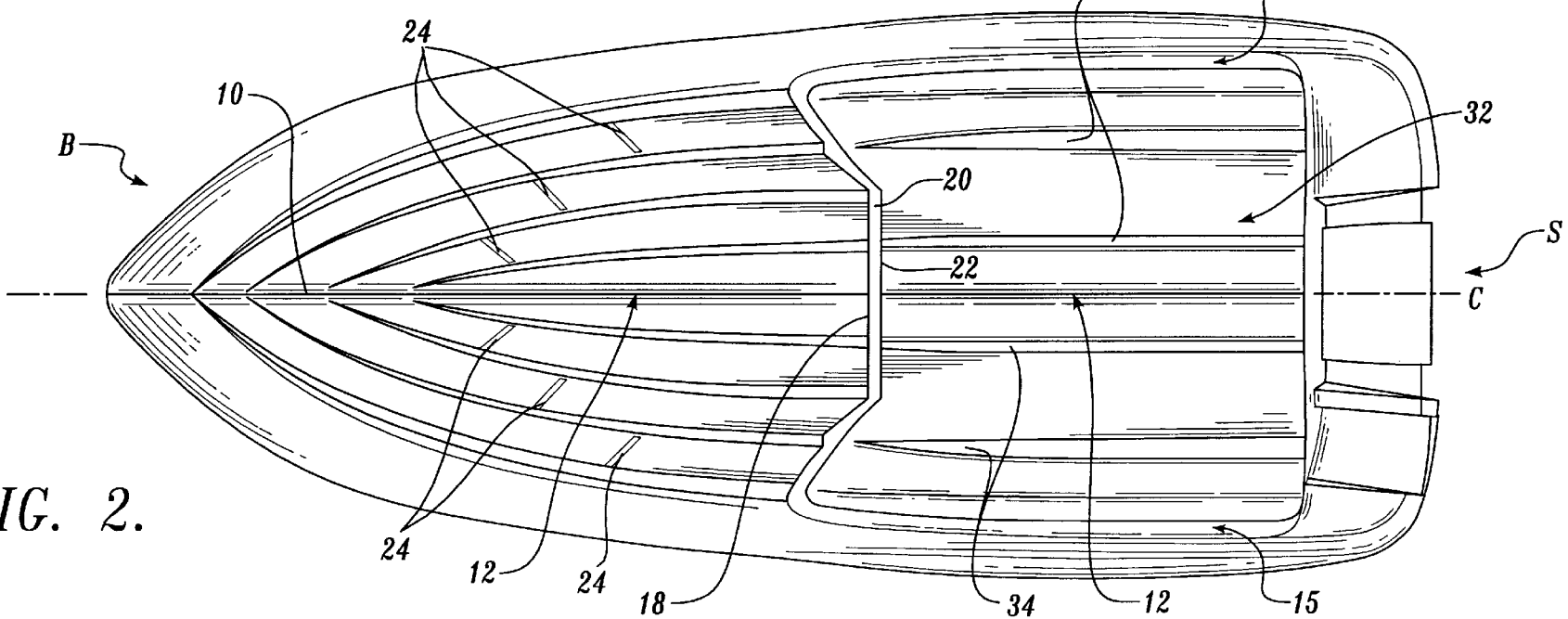
FIG. 2 is a schematic bottom view of the boat hull of FIG. 1.
Figure 3:
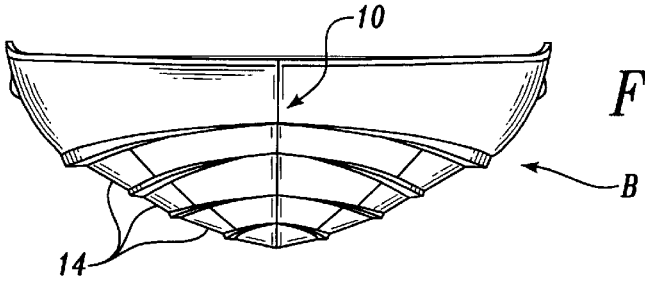
FIG. 3 is a schematic front view of the embodiment of the boat hull of FIG. 1.
Figure 4:
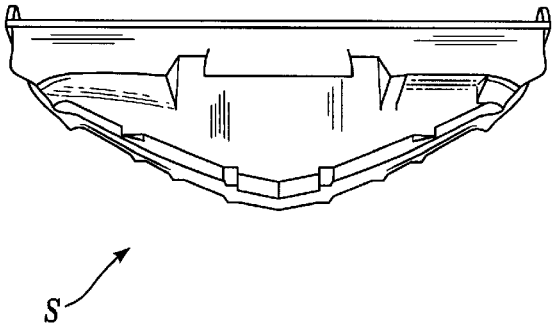
FIG. 4 is a rear view, schematically depicting the stern of the boat hull of FIG. 1.

As seen more clearly in FIG. 2, each of the panels 14 extends rearward from the stem of the boat to the forward edge 18 of the step 20, that divides the hull into a bow portion and a stern portion. In the design shown, the mid-portion of the length of the step 20 is substantially straight and at right angles to the keel of the boat. The outer ends of the step are arcuately curved forward, and then aft and upward so that their ends merge into the chine 15 of the boat. A trailing edge 22 of the dividing step 20 defines the forward edge of the stern portion of the hull 32 that extends toward the stem of the boat. Referring to FIGS. 2 and 5, this stem portion of the hull of the boat includes at least one longitudinal outboard-extending ridge 34 on either side of the keel that provides additional stability when the boat is underway in the water.

Figure 6A:
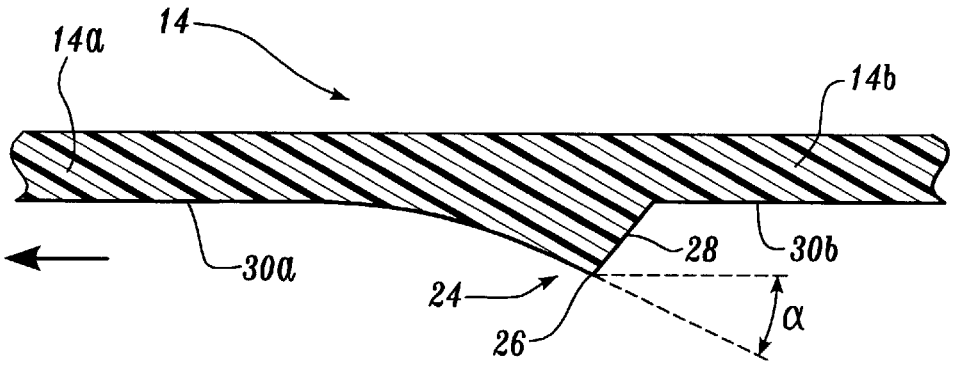
FIG. 6A is a cross-sectional view taken at 6—6 of FIG. 5 showing the structure of an embodiment of the laminar flow interrupters, in accordance with the invention.

Other details of the panels 14 are more clearly shown in FIGS. 5 and 6A–C where the directional arrows point toward the stem of the boat. Importantly, each of the forward end panels 14*a* has an outer surface 30*a* that curves smoothly, following the curvature of the hull, from the stem of the boat toward the laminar flow interrupters 24 of the invention. As shown in FIG. 6A, a short distance before the interrupter, the surface 30*a* of the panel flares outboard at an angle $\alpha$, that is not critical, but is preferably less than 90°. The flaring surface terminates in an outward extending leading edge 26 of the interrupter. A wall 28 extends inboard from this edge 26 of the ridge such that its inboard edge defines the frontal extremity of a rear portion 14*b* of the strake. Preferably, the outer surface 30*b* of the rear portion 14*b* of the strake, and the outer surface 30*a* of the forward portion 14*a* of the strake, are aligned to substantially follow the general curvature of the boat hull.

Figure 6B:
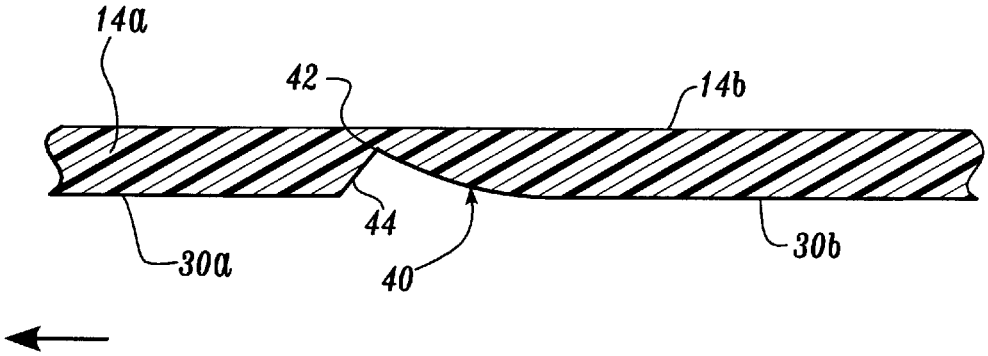
FIG. 6B is a cross-sectional view taken at 6—6 of FIG. 5 showing the structure of an alternative embodiment of the laminar flow interrupters in accordance with the invention.

In an alternative embodiment, shown in FIG. 6B, the laminar flow interrupter 24 is in the form of a trough. The trough is formed by a leading wall 40 angled inwardly and rearward from an outer surface 30*a* of the panel 14*a* to a deepest extremity 42. From this extremity 42, the trailing wall 44 of the trough curves rearward and outward to the surface 30*b* of the panel section 14*b*, that is substantially coplanar with surface 30*a*. The longitudinal trough thus formed disrupts laminar flow over the surface of the hull.

Figure 6C:
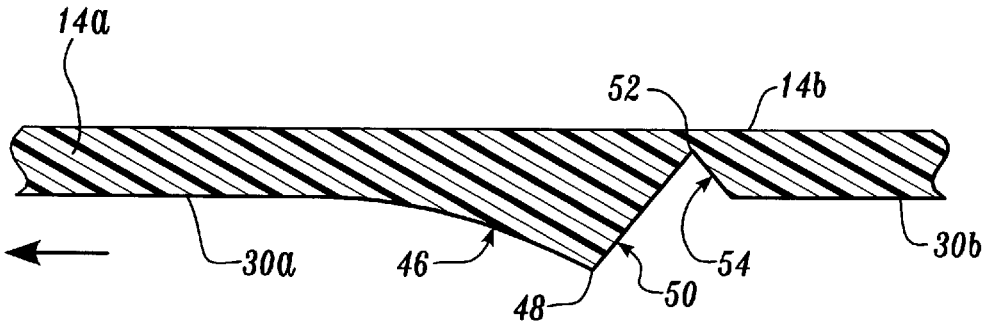
FIG. 6C is a cross-sectional view taken at 6—6 of FIG. 5 showing a further alternative structure of an embodiment of the laminar flow interrupters in accordance with the invention.

FIG. 6C illustrates a further alternative embodiment of the laminar flow interrupters 24 of the invention. In this embodiment, the outer surface 30*a* of the panel section 14*a* flares outward in a curving wall 46 to an outermost extremity 48. A wall 50 extends from the outermost extremity 48 inward and rearward to an innermost extremity 52 inward from surface 30*b* of panel section 14*b*. From this innermost extremity, a trailing wall 54 extends outward and rearward to the outer surface 30*b* of the hull, that is substantially coplanar with surface 30*a*. Thus, the interrupter includes both a ridge formed by walls 46 and 50 followed by a trough formed by walls 50 and 54, with wall 50 in common. The interrupter operates in substantially the same manner as the other embodiments, described above, to disrupt laminar flow of water over the hull.

In accordance with the invention, the degree, or extent, of modification of the hull surface to disrupt laminar flow is to some extent dependent upon the size of the hull. Nevertheless, a person of skill in the art, having read this disclosure, will be able to modify the extent of outward projection, or inward projection, of the interrupters, as described above, for a variety of hull sizes and hull shapes. As a practical guide, for a boat hull of about 20 feet in length, the interrupter extends about ¾ inches from the smooth outer surface 30 of the hull. Importantly, when the watercraft is underway, in a substantially straight course, the laminar flow interrupters are not submerged, so that they do not provide additional drag forces on the hull. Instead, the bow portion of the hull extends above the water with its keel portion skimming the water while the rear section of the hull is at least partially submerged in the water. Thus, drag forces on the hull are not affected in normal cruising. The bow portion is only partially submerged when the craft turns and at least some of the laminar flow interrupters are then brought into operation to disrupt laminar flow patterns over the hull.

Clearly, the invention is applicable to the hulls of all manner of watercraft, where the hull becomes submerged in water under circumstances that lead to laminar flow over the hull causing the side-to-side or porpoising type of oscillation, discussed above. Thus, the invention is applicable to the hulls of, for instance, boats, catamarans, seaplanes, jet skis, and the like.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A watercraft having a hull comprising laminar flow interrupters only on an upper area of a bow portion of the hull, the interrupters arranged on the bow portion such that a leading interrupter is nearest a stem and a keel of the hull and other interrupters are progressively spaced further from the stem and the keel, the interrupters disrupting laminar flow of water over the upper area of the bow portion when the watercraft turns in water, and the interrupters not extending below a waterline of the hull when the watercraft cruises in a substantially straight path.

2. The watercraft of claim 1, wherein the interrupters comprise outward-extending ridges on a side of the hull.

3. The watercraft of claim 2, wherein the ridges comprise a first wall flaring smoothly outward from an outer surface of the hull, when viewed from a stern of the watercraft, and a second wall extending inward from an outermost extremity of the first wall toward the hull, to form a ridge for interrupting laminar flow of water over the hull, when the watercraft is turning in water.

4. The watercraft of claim 1, wherein a laminar flow interrupter comprises a trough in a curvature of the hull, the trough of sufficient depth to cause interruption of laminar flow over the hull, when the watercraft is turning in water.

5. The watercraft of claim 4, wherein a leading edge of the trough curves smoothly inward as viewed from a stem of the hull, and terminates in an outward-extending wall of sufficient height to disrupt laminar flow of water over the hull, when the watercraft is turning in water.

6. The watercraft of claim 1, wherein the laminar flow interrupter comprises a ridge extending outward from the hull, and a trough extending inward, the trough located aft of the ridge such that a common wall is formed by a rear wall of the ridge and a forward wall of the trough.

7. The watercraft of claim 1, wherein the interrupters comprise ridges and troughs in the bow portion of the hull.

8. A watercraft having a hull comprising a bow portion, the bow portion comprising upper areas, extending from each of two sides of a central keel of the hull, the upper areas each comprising an outer surface equipped with means for disruption of laminar flow of water over the upper area of the hull, the means for disruption arranged on the bow portion such that a leading one of the means is nearest a stem and a keel of the hull and other ones of the means are progressively spaced further from the stem and the keel, the means not extending to areas of the hull that submerge below a waterline when the watercraft is in motion in water in a substantially straight path.

* * * * *